US009314839B2

(12) United States Patent
Prest et al.

(10) Patent No.: US 9,314,839 B2
(45) Date of Patent: Apr. 19, 2016

(54) CAST CORE INSERT OUT OF ETCHABLE MATERIAL

(75) Inventors: Christopher D. Prest, San Francisco, CA (US); Matthew S. Scott, Campbell, CA (US); Stephen P. Zadesky, Portola Valley, CA (US); Dermot J. Stratton, San Francisco, CA (US); Joseph C. Poole, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 490 days.

(21) Appl. No.: 13/541,848

(22) Filed: Jul. 5, 2012

(65) Prior Publication Data

US 2014/0007984 A1 Jan. 9, 2014

(51) Int. Cl.
*B22D 29/00* (2006.01)
*C22C 1/02* (2006.01)

(52) U.S. Cl.
CPC ..... *B22D 29/002* (2013.01); *C22C 1/02* (2013.01)

(58) Field of Classification Search
CPC ..... B22D 29/00; B22D 29/002; B22C 9/10
USPC ..... 164/131, 132, 137, 369
See application file for complete search history.

(56) References Cited

U.S. PATENT DOCUMENTS

| | | | |
|---|---|---|---|
| 3,671,029 | A | 6/1972 | Kurlsson |
| 3,731,727 | A | 5/1973 | Mitamura et al. |
| 4,040,845 | A | 8/1977 | Richerson et al. |
| 4,135,568 | A | 1/1979 | Brooks |
| 4,265,294 | A | 5/1981 | Gaule |
| 4,550,412 | A | 10/1985 | Holcombe et al. |
| 4,612,973 | A | 9/1986 | Whang |
| 4,678,024 | A | 7/1987 | Hull |
| 4,693,299 | A | 9/1987 | Kuznetsov et al. |
| 4,799,532 | A | 1/1989 | Mizuhara |
| 4,887,798 | A | 12/1989 | Julius |
| 5,003,551 | A | 3/1991 | Mortimer |
| 5,087,804 | A | 2/1992 | McGaffigne |
| 5,288,344 | A | 2/1994 | Peker |

(Continued)

FOREIGN PATENT DOCUMENTS

| | | |
|---|---|---|
| CN | 102433518 | 5/2012 |
| DE | 19902002 | 7/2000 |

(Continued)

OTHER PUBLICATIONS

Inoue et al., "Bulk amorphous alloys with high mechanical strength and good soft magnetic properties in Fe—Tm—B (TM=IV-VIII group transition metal) system", Appl. Phys. Lett., vol. 71, p. 464 (1997).

(Continued)

*Primary Examiner* — Kevin E Yoon
(74) *Attorney, Agent, or Firm* — Brownstein Hyatt Farber Schreck, LLP

(57) ABSTRACT

Provided in an embodiment is a method for molding, including: providing a molten alloy in a space between a mold cavity and an etchable block shaped to form an undercut on a part formed in the space, cooling the molten alloy to form the part with the undercut, and etching the etchable block. An undercut is a beveled edge caused by an etchant attacking an etchable block laterally and optionally vertically. The formed part can be made of a bulk amorphous alloy. In some cases, the etchable block can also be used to form at least one threaded portion in the part.

20 Claims, 3 Drawing Sheets

(56) References Cited

U.S. PATENT DOCUMENTS

| | | | | |
|---|---|---|---|---|
| 5,368,659 | A | 11/1994 | Peker | |
| 5,487,421 | A | 1/1996 | Gerber | |
| 5,616,024 | A | 4/1997 | Nobori | |
| 5,618,359 | A | 4/1997 | Lin | |
| 5,711,363 | A | 1/1998 | Scruggs et al. | |
| 5,735,975 | A | 4/1998 | Lin | |
| 5,896,642 | A | 4/1999 | Peker | |
| 5,976,247 | A | 11/1999 | Hansen et al. | |
| 6,021,840 | A | 2/2000 | Colvin | |
| 6,029,738 | A * | 2/2000 | Matuura et al. | 164/369 |
| 6,189,600 | B1 | 2/2001 | Taniguchi et al. | |
| 6,267,170 | B1 | 7/2001 | Onuki | |
| 6,267,171 | B1 | 7/2001 | Onuki | |
| 6,283,197 | B1 | 9/2001 | Kono | |
| 6,325,868 | B1 | 12/2001 | Kim | |
| 6,371,195 | B1 | 4/2002 | Onuki | |
| 6,427,753 | B1 | 8/2002 | Inoue | |
| 6,564,856 | B1 * | 5/2003 | Buckley | 164/132 |
| 6,875,293 | B2 | 4/2005 | Peker | |
| 7,017,645 | B2 | 3/2006 | Johnson et al. | |
| 7,235,910 | B2 | 6/2007 | Decristofaro et al. | |
| 7,377,303 | B2 | 5/2008 | Go | |
| 7,488,170 | B2 | 2/2009 | Yuasa et al. | |
| 7,575,040 | B2 | 8/2009 | Johnson | |
| 7,708,844 | B2 | 5/2010 | Muramatsu | |
| 7,906,219 | B2 | 3/2011 | Ohara | |
| 8,807,198 | B2 * | 8/2014 | Bullied et al. | 164/113 |
| 2002/0005233 | A1 | 1/2002 | Schirra et al. | |
| 2005/0028961 | A1 | 2/2005 | Toyoshima et al. | |
| 2005/0242454 | A1 | 11/2005 | Yuasa et al. | |
| 2006/0042773 | A1 | 3/2006 | Eisen | |
| 2006/0254747 | A1 | 11/2006 | Ishida et al. | |
| 2007/0079907 | A1 | 4/2007 | Johnson | |
| 2008/0118387 | A1 | 5/2008 | Demetriou | |
| 2009/0236494 | A1 | 9/2009 | Hata et al. | |
| 2009/0321037 | A1 * | 12/2009 | Lewis et al. | 164/501 |
| 2010/0084052 | A1 | 4/2010 | Farmer | |
| 2010/0098967 | A1 | 4/2010 | Schroers | |
| 2010/0300148 | A1 | 12/2010 | Demetriou | |
| 2010/0313704 | A1 * | 12/2010 | Wang et al. | 74/640 |
| 2011/0011750 | A1 | 1/2011 | Lovens | |
| 2011/0079940 | A1 | 4/2011 | Schroers | |
| 2011/0108231 | A1 | 5/2011 | Zheng et al. | |

FOREIGN PATENT DOCUMENTS

| | | |
|---|---|---|
| EP | 0845316 | 6/1998 |
| EP | 1013363 | 6/2000 |
| EP | 1415740 | 5/2004 |
| FR | 2665654 | 2/1992 |
| GB | 392764 | 5/1933 |
| GB | 574914 | 1/1946 |
| GB | 784363 | 10/1957 |
| JP | 55036033 | 3/1980 |
| JP | 6212205 | 8/1994 |
| JP | 8013111 | 1/1996 |
| JP | 1994212205 | 3/1996 |
| JP | 9272929 | 10/1997 |
| JP | 1997272929 | 4/1999 |
| JP | 2000024767 | 1/2000 |
| JP | 2000326065 | 11/2000 |
| JP | 2001071113 | 3/2001 |
| JP | 2001259821 | 9/2001 |
| JP | 2001-303218 | 10/2001 |
| JP | 2001303218 | 10/2001 |
| JP | 2004050269 | 2/2004 |
| JP | 2006289466 | 10/2006 |
| JP | 2009068101 | 4/2009 |
| JP | 2009172627 | 8/2009 |
| JP | 2009173964 | 8/2009 |
| JP | 2010036210 | 2/2010 |
| WO | WO0037201 | 6/2000 |
| WO | WO0240727 | 5/2002 |
| WO | WO2005004559 | 1/2005 |
| WO | WO2006127792 | 11/2006 |
| WO | WO2008046219 | 4/2008 |
| WO | WO2009067512 | 5/2009 |
| WO | WO2010108744 | 9/2010 |
| WO | WO2010111701 | 9/2010 |
| WO | WO 2013/087040 | 6/2013 |

OTHER PUBLICATIONS

Shen Et., "Bulk Glassy CO43FE20TA5.5B31.5 Alloy with High Glass-Forming Ability and Good Soft Magnetic Properties", Materials Transactions, vol. 42 No. 10 (2001) pp. 2136-2139.

Wolf, S.; R.N. Tauber (1986),Silicon Processing for the VLSI Era: vol. 1—Process Technology. Lattice Press. pp. 531-534, 546.

Walker, Perrin; William H. Tarn (1991), CRC Handbook of Metal Etchants. pp. 287-291.

Kohler, Michael (1999), Etching in Microsystem Technology. John Wiley & Son Ltd. p. 329.

McDeavitt et al., "High Temperature Interaction Behavior at Liquid Metal-Ceramic Interfaces", Journal of Materials Engineering and Performance, vol. 11, Aug. 2002.

Kargahi et al., "Analysis of failure of conducting crucible used in induction metal". Aug. 1988.

Inoue et al., "Microstructure and Properties of Bulky Al84Ni10Ce6 Alloys with Amorphous Surface Layer Prepared by High-Pressure Die Casting", Materials Transactions, JIM, vol. 36, No. 11 (1994), pp. 808-813.

* cited by examiner

PRIOR ART

PRIOR ART

CAST CORE INSERT OUT OF ETCHABLE MATERIAL

FIELD

This disclosure relates to methods of molding bulk solidifying amorphous alloy with undercut(s) using a mold cavity and an etchable block of material.

BACKGROUND

Until the early nineties, the processability of amorphous alloys was quite limited, and amorphous alloys were readily available only in powder form or in very thin foils or strips with a critical casting thickness of less than 100 micrometers. A new class of amorphous alloys based mostly on Zr and Ti alloy systems was developed in the nineties, and since then more amorphous alloy systems based on different elements have been developed. These families of alloys have much lower critical cooling rates of less than $10^{3}$° C./sec, and thus these articles have much larger critical casting thicknesses than their previous counterparts. The bulk-solidifying amorphous alloys are capable of being shaped into a variety of forms, thereby providing a unique advantage in preparing intricately designed parts.

The use of hard materials in the formation of intricately designed parts for a variety of uses significantly improves the life of the article, but also imposes difficulties in its manufacture and assembly. Many parts of articles, such as electronic devices, machine parts, engines, pump impellers, rotors, and the like, must be formed or molded. For example, die casting generally consists of injecting molten metal under high pressure into a mold.

When working with alloys such as bulk amorphous alloys, it is difficult to make intricate details such as undercuts and threaded portions using movable mold tools, because the molten alloy can fill any gaps or holes in the movable mold tools. Thus, it would be desirable to provide an improved method and system for molding and using a mold to form a part with such detail.

SUMMARY

One aspect of this disclosure provides a method for molding, including: providing a molten alloy in a space between a mold cavity and an etchable block shaped to form an undercut on a part formed in the space, cooling the molten alloy to form the part with the undercut, the part comprising a bulk amorphous alloy, and etching the etchable block.

Another aspect provides a method for using a mold, the mold including a first mold part and a second mold part configured to receive bulk amorphous alloy material for molding therebetween; the first and second mold parts comprising a negative pattern for molding the bulk amorphous alloy; the method including: providing the first mold part and the second mold part; providing bulk amorphous alloy into the first and second mold parts; hardening the bulk amorphous alloy; removing the first mold part of the mold, and removing the second mold part of the mold, wherein the second mold part includes an etchable material, and wherein the removing of the second mold part includes etching the etchable material of the second mold part from the hardened bulk amorphous alloy.

Yet another aspect provides a part for an electronic device comprising a bulk amorphous alloy, the part having an outer wall and an inner wall, wherein the part has an undercut projecting from the inner wall.

Other features and advantages of the present disclosure will become apparent from the following detailed description, the accompanying drawings, and the appended claims.

DETAILED DESCRIPTION

All publications, patents, and patent applications cited in this Specification are hereby incorporated by reference in their entirety.

The articles "a" and "an" are used herein to refer to one or to more than one (i.e., to at least one) of the grammatical object of the article. By way of example, "a polymer resin" means one polymer resin or more than one polymer resin. Any ranges cited herein are inclusive. The terms "substantially" and "about" used throughout this Specification are used to describe and account for small fluctuations. For example, they can refer to less than or equal to ±5%, such as less than or equal to ±2%, such as less than or equal to ±1%, such as less than or equal to ±0.5%, such as less than or equal to ±0.2%, such as less than or equal to ±0.1%, such as less than or equal to ±0.05%.

Bulk-solidifying amorphous alloys, or bulk metallic glasses ("BMG"), are a recently developed class of metallic materials. These alloys may be solidified and cooled at relatively slow rates, and they retain the amorphous, non-crystalline (i.e., glassy) state at room temperature. Amorphous alloys have many superior properties than their crystalline counterparts. However, if the cooling rate is not sufficiently high, crystals may form inside the alloy during cooling, so that the benefits of the amorphous state can be lost. For example, one challenge with the fabrication of bulk amorphous alloy parts is partial crystallization of the parts due to either slow cooling or impurities in the raw alloy material. As a high degree of amorphicity (and, conversely, a low degree of crystallinity) is desirable in BMG parts, there is a need to develop methods for casting BMG parts having controlled amount of amorphicity.

Figure 1:
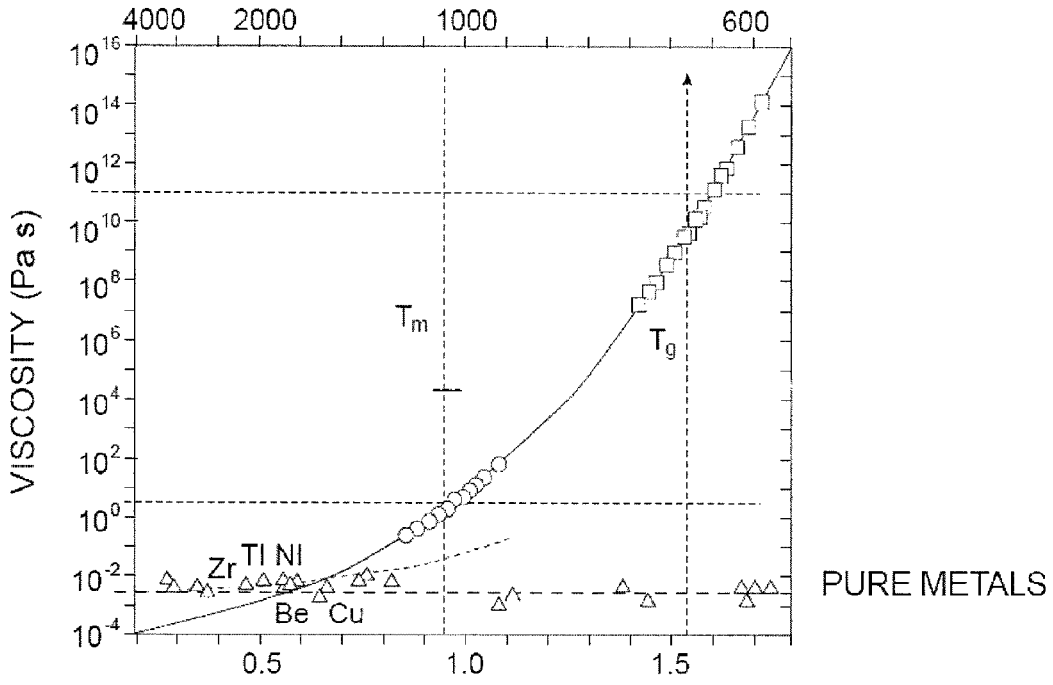
FIG. 1 provides a temperature-viscosity diagram of an exemplary bulk solidifying amorphous alloy.

FIG. 1 (obtained from U.S. Pat. No. 7,575,040) shows a viscosity-temperature graph of an exemplary bulk solidifying amorphous alloy, from the VIT-001 series of Zr—Ti—Ni—Cu—Be family manufactured by Liquidmetal Technology. It should be noted that there is no clear liquid/solid transformation for a bulk solidifying amorphous metal during the formation of an amorphous solid. The molten alloy becomes more and more viscous with increasing undercooling until it approaches solid form around the glass transition temperature. Accordingly, the temperature of solidification front for bulk solidifying amorphous alloys can be around glass transition temperature, where the alloy will practically act as a solid for the purposes of pulling out the quenched amorphous sheet product.

Figure 2:
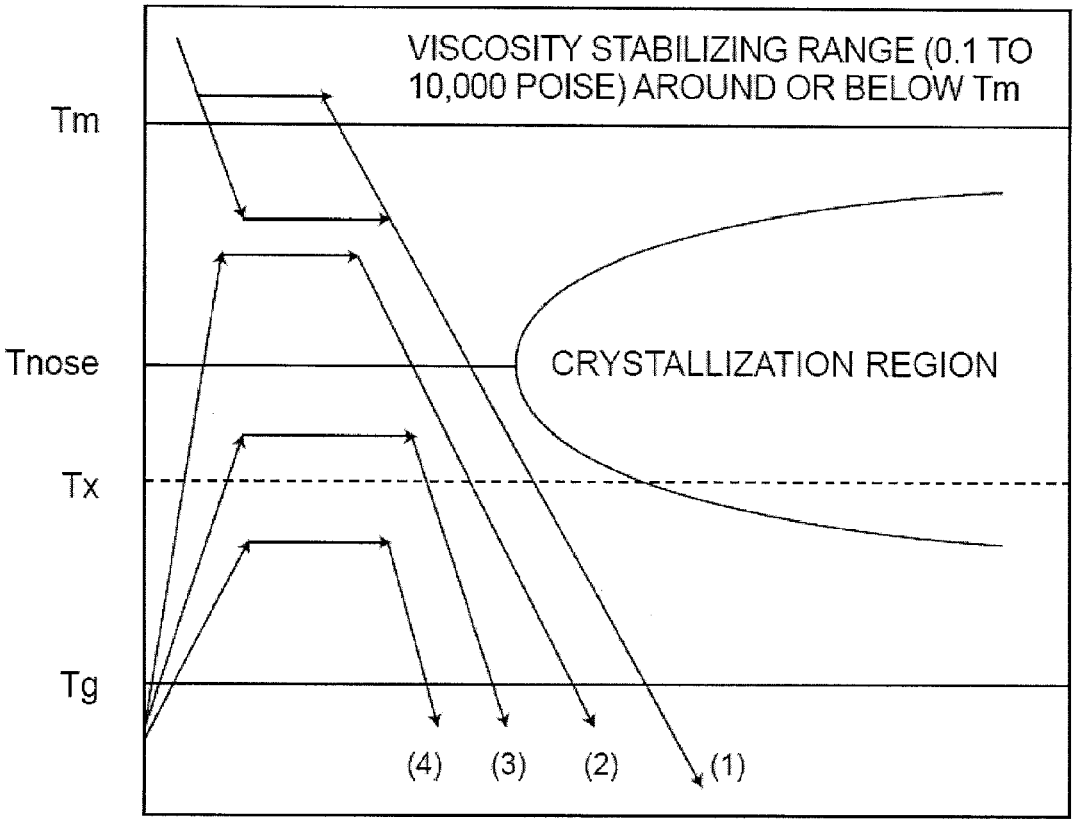
FIG. 2 provides a schematic of a time-temperature-transformation (TTT) diagram for an exemplary bulk solidifying amorphous alloy.

FIG. 2 (obtained from U.S. Pat. No. 7,575,040) shows the time-temperature-transformation (TTT) cooling curve of an exemplary bulk solidifying amorphous alloy, or TTT diagram. Bulk-solidifying amorphous metals do not experience a liquid/solid crystallization transformation upon cooling, as with conventional metals. Instead, the highly fluid, non crystalline form of the metal found at high temperatures (near a "melting temperature" Tm) becomes more viscous as the temperature is reduced (near to the glass transition temperature Tg), eventually taking on the outward physical properties of a conventional solid.

Even though there is no liquid/crystallization transformation for a bulk solidifying amorphous metal, a "melting temperature" Tm may be defined as the thermodynamic liquidus temperature of the corresponding crystalline phase. Under this regime, the viscosity of bulk-solidifying amorphous alloys at the melting temperature could lie in the range of about 0.1 poise to about 10,000 poise, and even sometimes under 0.01 poise. A lower viscosity at the "melting temperature" would provide faster and complete filling of intricate portions of the shell/mold with a bulk solidifying amorphous metal for forming the BMG parts. Furthermore, the cooling rate of the molten metal to form a BMG part has to such that the time-temperature profile during cooling does not traverse through the nose-shaped region bounding the crystallized region in the TTT diagram of FIG. 2. In FIG. 2, Those is the critical crystallization temperature Tx where crystallization is most rapid and occurs in the shortest time scale.

The supercooled liquid region, the temperature region between Tg and Tx is a manifestation of the extraordinary stability against crystallization of bulk solidification alloys. In this temperature region the bulk solidifying alloy can exist as a high viscous liquid. The viscosity of the bulk solidifying alloy in the supercooled liquid region can vary between 1012 Pa s at the glass transition temperature down to 105 Pa s at the crystallization temperature, the high temperature limit of the supercooled liquid region. Liquids with such viscosities can undergo substantial plastic strain under an applied pressure. The embodiments herein make use of the large plastic formability in the supercooled liquid region as a forming and separating method.

One needs to clarify something about Tx. Technically, the nose-shaped curve shown in the TTT diagram describes Tx as a function of temperature and time. Thus, regardless of the trajectory that one takes while heating or cooling a metal alloy, when one hits the TTT curve, one has reached Tx. In FIG. 1, Tx is shown as a dashed line as Tx can vary from close to Tm to close to Tg.

The schematic TTT diagram of FIG. 2 shows processing methods of die casting from at or above Tm to below Tg without the time-temperature trajectory (shown as (1) as an example trajectory) hitting the TTT curve. During die casting, the forming takes place substantially simultaneously with fast cooling to avoid the trajectory hitting the TTT curve. The processing methods for superplastic forming (SPF) from at or below Tg to below Tm without the time-temperature trajectory (shown as (2), (3) and (4) as example trajectories) hitting the TTT curve. In SPF, the amorphous BMG is reheated into the supercooled liquid region where the available processing window could be much larger than die casting, resulting in better controllability of the process. The SPF process does not require fast cooling to avoid crystallization during cooling. Also, as shown by example trajectories (2), (3) and (4), the SPF can be carried out with the highest temperature during SPF being above Tnose or below Tnose, up to about Tm. If one heats up a piece of amorphous alloy but manages to avoid hitting the TTT curve, you have heated "between Tg and Tm", but one would have not reached Tx.

Typical differential scanning calorimeter (DSC) heating curves of bulk-solidifying amorphous alloys taken at a heating rate of 20 C/min describe, for the most part, a particular trajectory across the TTT data where one would likely see a Tg at a certain temperature, a Tx when the DSC heating ramp crosses the TTT crystallization onset, and eventually melting peaks when the same trajectory crosses the temperature range for melting. If one heats a bulk-solidifying amorphous alloy at a rapid heating rate as shown by the ramp up portion of trajectories (2), (3) and (4) in FIG. 2, then one could avoid the TTT curve entirely, and the DSC data would show a glass transition but no Tx upon heating. Another way to think about it is trajectories (2), (3) and (4) can fall anywhere in temperature between the nose of the TTT curve (and even above it) and the Tg line, as long as it does not hit the crystallization curve. That just means that the horizontal plateau in trajectories might get much shorter as one increases the processing temperature.

Phase

The term "phase" herein can refer to one that can be found in a thermodynamic phase diagram. A phase is a region of space (e.g., a thermodynamic system) throughout which all physical properties of a material are essentially uniform. Examples of physical properties include density, index of refraction, chemical composition and lattice periodicity. A simple description of a phase is a region of material that is chemically uniform, physically distinct, and/or mechanically separable. For example, in a system consisting of ice and water in a glass jar, the ice cubes are one phase, the water is a second phase, and the humid air over the water is a third phase. The glass of the jar is another separate phase. A phase can refer to a solid solution, which can be a binary, tertiary, quaternary, or more, solution, or a compound, such as an intermetallic compound. As another example, an amorphous phase is distinct from a crystalline phase.

Metal, Transition Metal, and Non-Metal

The term "metal" refers to an electropositive chemical element. The term "element" in this Specification refers generally to an element that can be found in a Periodic Table. Physically, a metal atom in the ground state contains a partially filled band with an empty state close to an occupied state. The term "transition metal" is any of the metallic elements within Groups 3 to 12 in the Periodic Table that have an incomplete inner electron shell and that serve as transitional links between the most and the least electropositive in a series of elements. Transition metals are characterized by multiple valences, colored compounds, and the ability to form stable complex ions. The term "nonmetal" refers to a chemical element that does not have the capacity to lose electrons and form a positive ion.

Depending on the application, any suitable nonmetal elements, or their combinations, can be used. The alloy (or "alloy composition") can comprise multiple nonmetal elements, such as at least two, at least three, at least four, or more, nonmetal elements. A nonmetal element can be any element that is found in Groups 13-17 in the Periodic Table. For example, a nonmetal element can be any one of F, Cl, Br, I, At, O, S, Se, Te, Po, N, P, As, Sb, Bi, C, Si, Ge, Sn, Pb, and B. Occasionally, a nonmetal element can also refer to certain metalloids (e.g., B, Si, Ge, As, Sb, Te, and Po) in Groups 13-17. In one embodiment, the nonmetal elements can include B, Si, C, P, or combinations thereof. Accordingly, for example, the alloy can comprise a boride, a carbide, or both.

A transition metal element can be any of scandium, titanium, vanadium, chromium, manganese, iron, cobalt, nickel, copper, zinc, yttrium, zirconium, niobium, molybdenum, technetium, ruthenium, rhodium, palladium, silver, cadmium, hafnium, tantalum, tungsten, rhenium, osmium, iridium, platinum, gold, mercury, rutherfordium, dubnium, seaborgium, bohrium, hassium, meitnerium, ununnilium, ununununium, and ununbium. In one embodiment, a BMG containing a transition metal element can have at least one of Sc, Y, La, Ac, Ti, Zr, Hf, V, Nb, Ta, Cr, Mo, W, Mn, Tc, Re, Fe, Ru, Os, Co, Rh, Ir, Ni, Pd, Pt, Cu, Ag, Au, Zn, Cd, and Hg. Depending on the application, any suitable transitional metal elements, or their combinations, can be used. The alloy composition can comprise multiple transitional metal elements, such as at least two, at least three, at least four, or more, transitional metal elements.

The presently described alloy or alloy "sample" or "specimen" alloy can have any shape or size. For example, the alloy can have a shape of a particulate, which can have a shape such as spherical, ellipsoid, wire-like, rod-like, sheet-like, flake-like, or an irregular shape. The particulate can have any size. For example, it can have an average diameter of between about 1 micron and about 100 microns, such as between about 5 microns and about 80 microns, such as between about 10 microns and about 60 microns, such as between about 15 microns and about 50 microns, such as between about 15 microns and about 45 microns, such as between about 20 microns and about 40 microns, such as between about 25 microns and about 35 microns. For example, in one embodiment, the average diameter of the particulate is between about 25 microns and about 44 microns. In some embodiments, smaller particulates, such as those in the nanometer range, or larger particulates, such as those bigger than 100 microns, can be used.

The alloy sample or specimen can also be of a much larger dimension. For example, it can be a bulk structural component, such as an ingot, housing/casing of an electronic device or even a portion of a structural component that has dimensions in the millimeter, centimeter, or meter range.

Solid Solution

The term "solid solution" refers to a solid form of a solution. The term "solution" refers to a mixture of two or more substances, which may be solids, liquids, gases, or a combination of these. The mixture can be homogeneous or heterogeneous. The term "mixture" is a composition of two or more substances that are combined with each other and are generally capable of being separated. Generally, the two or more substances are not chemically combined with each other.

Alloy

In some embodiments, the alloy composition described herein can be fully alloyed. In one embodiment, an "alloy" refers to a homogeneous mixture or solid solution of two or more metals, the atoms of one replacing or occupying interstitial positions between the atoms of the other; for example, brass is an alloy of zinc and copper. An alloy, in contrast to a composite, can refer to a partial or complete solid solution of one or more elements in a metal matrix, such as one or more compounds in a metallic matrix. The term alloy herein can refer to both a complete solid solution alloy that can give single solid phase microstructure and a partial solution that can give two or more phases. An alloy composition described herein can refer to one comprising an alloy or one comprising an alloy-containing composite.

Thus, a fully alloyed alloy can have a homogenous distribution of the constituents, be it a solid solution phase, a compound phase, or both. The term "fully alloyed" used herein can account for minor variations within the error tolerance. For example, it can refer to at least 90% alloyed, such as at least 95% alloyed, such as at least 99% alloyed, such as at least 99.5% alloyed, such as at least 99.9% alloyed. The percentage herein can refer to either volume percent or weight percentage, depending on the context. These percentages can be balanced by impurities, which can be in terms of composition or phases that are not a part of the alloy.

Amorphous or Non-Crystalline Solid

An "amorphous" or "non-crystalline solid" is a solid that lacks lattice periodicity, which is characteristic of a crystal. As used herein, an "amorphous solid" includes "glass" which is an amorphous solid that softens and transforms into a liquid-like state upon heating through the glass transition. Generally, amorphous materials lack the long-range order characteristic of a crystal, though they can possess some short-range order at the atomic length scale due to the nature of chemical bonding. The distinction between amorphous solids and crystalline solids can be made based on lattice periodicity as determined by structural characterization techniques such as x-ray diffraction and transmission electron microscopy.

The terms "order" and "disorder" designate the presence or absence of some symmetry or correlation in a many-particle system. The terms "long-range order" and "short-range order" distinguish order in materials based on length scales.

The strictest form of order in a solid is lattice periodicity: a certain pattern (the arrangement of atoms in a unit cell) is repeated again and again to form a translationally invariant tiling of space. This is the defining property of a crystal. Possible symmetries have been classified in 14 Bravais lattices and 230 space groups.

Lattice periodicity implies long-range order. If only one unit cell is known, then by virtue of the translational symmetry it is possible to accurately predict all atomic positions at arbitrary distances. The converse is generally true, except, for example, in quasi-crystals that have perfectly deterministic tilings but do not possess lattice periodicity.

Long-range order characterizes physical systems in which remote portions of the same sample exhibit correlated behavior. This can be expressed as a correlation function, namely the spin-spin correlation function:

In the above function, s is the spin quantum number and x is the distance function within the particular system. This function is equal to unity when $x=x'$ and decreases as the distance $|x-x'|$ increases. Typically, it decays exponentially to zero at large distances, and the system is considered to be disordered. If, however, the correlation function decays to a constant value at large $|x-x'|$, then the system can be said to possess long-range order. If it decays to zero as a power of the distance, then it can be called quasi-long-range order. Note that what constitutes a large value of $|x-x'|$ is relative.

A system can be said to present quenched disorder when some parameters defining its behavior are random variables that do not evolve with time (i.e., they are quenched or frozen)—e.g., spin glasses. It is opposite to annealed disorder, where the random variables are allowed to evolve themselves. Embodiments herein include systems comprising quenched disorder.

The alloy described herein can be crystalline, partially crystalline, amorphous, or substantially amorphous. For example, the alloy sample/specimen can include at least some crystallinity, with grains/crystals having sizes in the nanometer and/or micrometer ranges. Alternatively, the alloy can be substantially amorphous, such as fully amorphous. In one embodiment, the alloy composition is at least substantially not amorphous, such as being substantially crystalline, such as being entirely crystalline.

In one embodiment, the presence of a crystal or a plurality of crystals in an otherwise amorphous alloy can be construed as a "crystalline phase" therein. The degree of crystallinity (or "crystallinity" for short in some embodiments) of an alloy can refer to the amount of the crystalline phase present in the alloy. The degree can refer to, for example, a fraction of crystals present in the alloy. The fraction can refer to volume fraction or weight fraction, depending on the context. A measure of how "amorphous" an amorphous alloy is can be amorphicity. Amorphicity can be measured in terms of a degree of crystallinity. For example, in one embodiment, an alloy having a low degree of crystallinity can be said to have a high degree of amorphicity. In one embodiment, for example, an alloy having 60 vol % crystalline phase can have a 40 vol % amorphous phase.

Amorphous Alloy or Amorphous Metal

An "amorphous alloy" is an alloy having an amorphous content of more than 50% by volume, preferably more than 90% by volume of amorphous content, more preferably more than 95% by volume of amorphous content, and most preferably more than 99% to almost 100% by volume of amorphous content. Note that, as described above, an alloy high in amorphicity is equivalently low in degree of crystallinity. An "amorphous metal" is an amorphous metal material with a disordered atomic-scale structure. In contrast to most metals, which are crystalline and therefore have a highly ordered arrangement of atoms, amorphous alloys are non-crystalline. Materials in which such a disordered structure is produced directly from the liquid state during cooling are sometimes referred to as "glasses." Accordingly, amorphous metals are commonly referred to as "metallic glasses" or "glassy metals." In one embodiment, a bulk metallic glass ("BMG") can refer to an alloy, of which the microstructure is at least partially amorphous. However, there are several ways besides extremely rapid cooling to produce amorphous metals, including physical vapor deposition, solid-state reaction, ion irradiation, melt spinning, and mechanical alloying. Amorphous alloys can be a single class of materials, regardless of how they are prepared.

Amorphous metals can be produced through a variety of quick-cooling methods. For instance, amorphous metals can be produced by sputtering molten metal onto a spinning metal disk. The rapid cooling, on the order of millions of degrees a second, can be too fast for crystals to form, and the material is thus "locked in" a glassy state. Also, amorphous metals/alloys can be produced with critical cooling rates low enough to allow formation of amorphous structures in thick layers—e.g., bulk metallic glasses.

The terms "bulk metallic glass" ("BMG"), bulk amorphous alloy ("BAA"), and bulk solidifying amorphous alloy are used interchangeably herein. They refer to amorphous alloys having the smallest dimension at least in the millimeter range. For example, the dimension can be at least about 0.5 mm, such as at least about 1 mm, such as at least about 2 mm, such as at least about 4 mm, such as at least about 5 mm, such as at least about 6 mm, such as at least about 8 mm, such as at least about 10 mm, such as at least about 12 mm. Depending on the geometry, the dimension can refer to the diameter, radius, thickness, width, length, etc. A BMG can also be a metallic glass having at least one dimension in the centimeter range, such as at least about 1.0 cm, such as at least about 2.0 cm, such as at least about 5.0 cm, such as at least about 10.0 cm. In some embodiments, a BMG can have at least one dimension at least in the meter range. A BMG can take any of the shapes or forms described above, as related to a metallic glass. Accordingly, a BMG described herein in some embodiments can be different from a thin film made by a conventional deposition technique in one important aspect—the former can be of a much larger dimension than the latter.

Amorphous metals can be an alloy rather than a pure metal. The alloys may contain atoms of significantly different sizes, leading to low free volume (and therefore having viscosity up to orders of magnitude higher than other metals and alloys) in a molten state. The viscosity prevents the atoms from moving enough to form an ordered lattice. The material structure may result in low shrinkage during cooling and resistance to plastic deformation. The absence of grain boundaries, the weak spots of crystalline materials in some cases, may, for example, lead to better resistance to wear and corrosion. In one embodiment, amorphous metals, while technically glasses, may also be much tougher and less brittle than oxide glasses and ceramics.

Thermal conductivity of amorphous materials may be lower than that of their crystalline counterparts. To achieve formation of an amorphous structure even during slower cooling, the alloy may be made of three or more components, leading to complex crystal units with higher potential energy and lower probability of formation. The formation of amorphous alloy can depend on several factors: the composition of the components of the alloy; the atomic radius of the components (preferably with a significant difference of over 12% to achieve high packing density and low free volume); and the negative heat of mixing the combination of components, inhibiting crystal nucleation and prolonging the time the molten metal stays in a supercooled state. However, as the formation of an amorphous alloy is based on many different variables, it can be difficult to make a prior determination of whether an alloy composition would form an amorphous alloy.

Amorphous alloys, for example, of boron, silicon, phosphorus, and other glass formers with magnetic metals (iron, cobalt, nickel) may be magnetic, with low coercivity and high electrical resistance. The high resistance leads to low losses by eddy currents when subjected to alternating magnetic fields, a property useful, for example, as transformer magnetic cores.

Amorphous alloys may have a variety of potentially useful properties. In particular, they tend to be stronger than crystalline alloys of similar chemical composition, and they can sustain larger reversible ("elastic") deformations than crystalline alloys. Amorphous metals derive their strength directly from their non-crystalline structure, which can have none of the defects (such as dislocations) that limit the strength of crystalline alloys. For example, one modern amorphous metal, known as Vitreloy™, has a tensile strength that is almost twice that of high-grade titanium. In some embodiments, metallic glasses at room temperature are not ductile and tend to fail suddenly when loaded in tension, which limits the material applicability in reliability-critical applications, as the impending failure is not evident. Therefore, to overcome this challenge, metal matrix composite materials having a metallic glass matrix containing dendritic particles or fibers of a ductile crystalline metal can be used. Alternatively, a BMG low in element(s) that tend to cause embitterment (e.g., Ni) can be used. For example, a Ni-free BMG can be used to improve the ductility of the BMG.

Another useful property of bulk amorphous alloys is that they can be true glasses; in other words, they can soften and flow upon heating. This can allow for easy processing, such as by injection molding, in much the same way as polymers. As a result, amorphous alloys can be used for making sports equipment, medical devices, electronic components and equipment, and thin films. Thin films of amorphous metals can be deposited as protective coatings via a high velocity oxygen fuel technique.

A material can have an amorphous phase, a crystalline phase, or both. The amorphous and crystalline phases can have the same chemical composition and differ only in the microstructure—i.e., one amorphous and the other crystalline. Microstructure in one embodiment refers to the structure of a material as revealed by a microscope at 25× magnification or higher. Alternatively, the two phases can have different chemical compositions and microstructures. For example, a composition can be partially amorphous, substantially amorphous, or completely amorphous.

As described above, the degree of amorphicity (and conversely the degree of crystallinity) can be measured by fraction of crystals present in the alloy. The degree can refer to volume fraction of weight fraction of the crystalline phase present in the alloy. A partially amorphous composition can refer to a composition of at least about 5 vol % of which is of an amorphous phase, such as at least about 10 vol %, such as at least about 20 vol %, such as at least about 40 vol %, such as at least about 60 vol %, such as at least about 80 vol %, such as at least about 90 vol %. The terms "substantially" and "about" have been defined elsewhere in this application. Accordingly, a composition that is at least substantially amorphous can refer to one of which at least about 90 vol % is amorphous, such as at least about 95 vol %, such as at least about 98 vol %, such as at least about 99 vol %, such as at least about 99.5 vol %, such as at least about 99.8 vol %, such as at least about 99.9 vol %. In one embodiment, a substantially amorphous composition can have some incidental, insignificant amount of crystalline phase present therein.

In one embodiment, an amorphous alloy composition can be homogeneous with respect to the amorphous phase. A substance that is uniform in composition is homogeneous. This is in contrast to a substance that is heterogeneous. The term "composition" refers to the chemical composition and/or microstructure in the substance. A substance is homogeneous when a volume of the substance is divided in half and both halves have substantially the same composition. For example, a particulate suspension is homogeneous when a volume of the particulate suspension is divided in half and both halves have substantially the same volume of particles. However, it might be possible to see the individual particles under a microscope. Another example of a homogeneous substance is air where different ingredients therein are equally suspended, though the particles, gases and liquids in air can be analyzed separately or separated from air.

A composition that is homogeneous with respect to an amorphous alloy can refer to one having an amorphous phase substantially uniformly distributed throughout its microstructure. In other words, the composition macroscopically comprises a substantially uniformly distributed amorphous alloy throughout the composition. In an alternative embodiment, the composition can be of a composite, having an amorphous phase having therein a non-amorphous phase. The non-amorphous phase can be a crystal or a plurality of crystals. The crystals can be in the form of particulates of any shape, such as spherical, ellipsoid, wire-like, rod-like, sheet-like, flake-like, or an irregular shape. In one embodiment, it can have a dendritic form. For example, an at least partially amorphous composite composition can have a crystalline phase in the shape of dendrites dispersed in an amorphous phase matrix; the dispersion can be uniform or non-uniform, and the amorphous phase and the crystalline phase can have the same or a different chemical composition. In one embodiment, they have substantially the same chemical composition. In another embodiment, the crystalline phase can be more ductile than the BMG phase.

The methods described herein can be applicable to any type of amorphous alloy. Similarly, the amorphous alloy described herein as a constituent of a composition or article can be of any type. The amorphous alloy can comprise the element Zr, Hf, Ti, Cu, Ni, Pt, Pd, Fe, Mg, Au, La, Ag, Al, Mo, Nb, Be, or combinations thereof. Namely, the alloy can include any combination of these elements in its chemical formula or chemical composition. The elements can be present at different weight or volume percentages. For example, an iron "based" alloy can refer to an alloy having a non-insignificant weight percentage of iron present therein, the weight percent can be, for example, at least about 20 wt %, such as at least about 40 wt %, such as at least about 50 wt %, such as at least about 60 wt %, such as at least about 80 wt %. Alternatively, in one embodiment, the above-described percentages can be volume percentages, instead of weight percentages. Accordingly, an amorphous alloy can be zirconium-based, titanium-based, platinum-based, palladium-based, gold-based, silver-based, copper-based, iron-based, nickel-based, aluminum-based, molybdenum-based, and the like. The alloy can also be free of any of the aforementioned elements to suit a particular purpose. For example, in some embodiments, the alloy, or the composition including the alloy, can be substantially free of nickel, aluminum, titanium, beryllium, or combinations thereof. In one embodiment, the alloy or the composite is completely free of nickel, aluminum, titanium, beryllium, or combinations thereof.

For example, the amorphous alloy can have the formula (Zr, Ti)a(Ni, Cu, Fe)b(Be, Al, Si, B)c, wherein a, b, and c each represents a weight or atomic percentage. In one embodiment, a is in the range of from 30 to 75, b is in the range of from 5 to 60, and c is in the range of from 0 to 50 in atomic percentages. Alternatively, the amorphous alloy can have the formula (Zr, Ti)a(Ni, Cu)b(Be)c, wherein a, b, and c each represents a weight or atomic percentage. In one embodiment, a is in the range of from 40 to 75, b is in the range of from 5 to 50, and c is in the range of from 5 to 50 in atomic percentages. The alloy can also have the formula (Zr, Ti)a(Ni, Cu)b(Be)c, wherein a, b, and c each represents a weight or atomic percentage. In one embodiment, a is in the range of from 45 to 65, b is in the range of from 7.5 to 35, and c is in the range of from 10 to 37.5 in atomic percentages. Alternatively, the alloy can have the formula (Zr)a(Nb, Ti)b(Ni, Cu)c(Al)d, wherein a, b, c, and d each represents a weight or atomic percentage. In one embodiment, a is in the range of from 45 to 65, b is in the range of from 0 to 10, c is in the range of from 20 to 40 and d is in the range of from 7.5 to 15 in atomic percentages. One exemplary embodiment of the aforedescribed alloy system is a Zr—Ti—Ni—Cu—Be based amorphous alloy under the trade name Vitreloy™, such as Vitreloy-1 and Vitreloy-101, as fabricated by Liquidmetal Technologies, CA, USA. Some examples of amorphous alloys of the different systems are provided in Table 1.

The amorphous alloys can also be ferrous alloys, such as (Fe, Ni, Co) based alloys. Examples of such compositions are disclosed in U.S. Pat. Nos. 6,325,868; 5,288,344; 5,368,659; 5,618,359; and 5,735,975, Inoue et al., Appl. Phys. Lett., Volume 71, p 464 (1997), Shen et al., Mater. Trans., JIM, Volume 42, p 2136 (2001), and Japanese Patent Application No. 200126277 (Pub. No. 2001303218 A). One exemplary composition is Fe72Al5Ga2P11C6B4. Another example is Fe72A17Zr10Mo5W2B15. Another iron-based alloy system that can be used in the coating herein is disclosed in U.S. Patent Application Publication No. 2010/0084052, wherein the amorphous metal contains, for example, manganese (1 to 3 atomic %), yttrium (0.1 to 10 atomic %), and silicon (0.3 to 3.1 atomic %) in the range of composition given in parentheses; and that contains the following elements in the specified range of composition given in parentheses: chromium (15 to 20 atomic %), molybdenum (2 to 15 atomic %), tungsten (1 to 3 atomic %), boron (5 to 16 atomic %), carbon (3 to 16 atomic %), and the balance iron.

The aforedescribed amorphous alloy systems can further include additional elements, such as additional transition metal elements, including Nb, Cr, V, and Co. The additional elements can be present at less than or equal to about 30 wt %, such as less than or equal to about 20 wt %, such as less than or equal to about 10 wt %, such as less than or equal to about 5 wt %. In one embodiment, the additional, optional element is at least one of cobalt, manganese, zirconium, tantalum, niobium, tungsten, yttrium, titanium, vanadium and hafnium to form carbides and further improve wear and corrosion resistance. Further optional elements may include phosphorous, germanium and arsenic, totaling up to about 2%, and preferably less than 1%, to reduce melting point. Otherwise incidental impurities should be less than about 2% and preferably 0.5%.

TABLE 1

Exemplary amorphous alloy compositions

| Alloy | Atm % | Atm % | Atm % | Atm % | Atm % | Atm % |
|---|---|---|---|---|---|---|
| 1 | Zr | Ti | Cu | Ni | Be | |
| | 41.20% | 13.80% | 12.50% | 10.00% | 22.50% | |
| 2 | Zr | Ti | Cu | Ni | Be | |
| | 44.00% | 11.00% | 10.00% | 10.00% | 25.00% | |
| 3 | Zr | Ti | Cu | Ni | Nb | Be |
| | 56.25% | 11.25% | 6.88% | 5.63% | 7.50% | 12.50% |
| 4 | Zr | Ti | Cu | Ni | Al | Be |
| | 64.75% | 5.60% | 14.90% | 11.15% | 2.60% | 1.00% |
| 5 | Zr | Ti | Cu | Ni | Al | |
| | 52.50% | 5.00% | 17.90% | 14.60% | 10.00% | |
| 6 | Zr | Nb | Cu | Ni | Al | |
| | 57.00% | 5.00% | 15.40% | 12.60% | 10.00% | |
| 7 | Zr | Cu | Ni | Al | Sn | |
| | 50.75% | 36.23% | 4.03% | 9.00% | 0.50% | |
| 8 | Zr | Ti | Cu | Ni | Be | |
| | 46.75% | 8.25% | 7.50% | 10.00% | 27.50% | |
| 9 | Zr | Ti | Ni | Be | | |
| | 21.67% | 43.33% | 7.50% | 27.50% | | |
| 10 | Zr | Ti | Cu | Be | | |
| | 35.00% | 30.00% | 7.50% | 27.50% | | |
| 11 | Zr | Ti | Co | Be | | |
| | 35.00% | 30.00% | 6.00% | 29.00% | | |
| 12 | Au | Ag | Pd | Cu | Si | |
| | 49.00% | 5.50% | 2.30% | 26.90% | 16.30% | |
| 13 | Au | Ag | Pd | Cu | Si | |
| | 50.90% | 3.00% | 2.30% | 27.80% | 16.00% | |

TABLE 1-continued

Exemplary amorphous alloy compositions

| Alloy | Atm % | Atm % | Atm % | Atm % | Atm % | Atm % |
|---|---|---|---|---|---|---|
| 14 | Pt | Cu | Ni | P | | |
| | 57.50% | 14.70% | 5.30% | 22.50% | | |
| 15 | Zr | Ti | Nb | Cu | Be | |
| | 36.60% | 31.40% | 7.00% | 5.90% | 19.10% | |
| 16 | Zr | Ti | Nb | Cu | Be | |
| | 38.30% | 32.90% | 7.30% | 6.20% | 15.30% | |
| 17 | Zr | Ti | Nb | Cu | Be | |
| | 39.60% | 33.90% | 7.60% | 6.40% | 12.50% | |
| 18 | Cu | Ti | Zr | Ni | | |
| | 47.00% | 34.00% | 11.00% | 8.00% | | |
| 19 | Zr | Co | Al | | | |
| | 55.00% | 25.00% | 20.00% | | | |

Other exemplary ferrous metal-based alloys include compositions such as those disclosed in U.S. Patent Application Publication Nos. 2007/0079907 and 2008/0118387. These compositions include the Fe(Mn, Co, Ni, Cu) (C, Si, B, P, Al) system, wherein the Fe content is from 60 to 75 atomic percentage, the total of (Mn, Co, Ni, Cu) is in the range of from 5 to 25 atomic percentage, and the total of (C, Si, B, P, Al) is in the range of from 8 to 20 atomic percentage, as well as the exemplary composition $Fe_{48}Cr_{15}Mo_{14}Y_2C_{15}B_6$. They also include the alloy systems described by Fe—Cr—Mo—(Y,Ln)-C—B, Co—Cr—Mo-Ln-C—B, Fe—Mn—Cr—Mo—(Y,Ln)-C—B, (Fe, Cr, Co)—(Mo,Mn)—(C,B)—Y, Fe—(Co,Ni)—(Zr,Nb,Ta)—(Mo,W)—B, Fe—(Al,Ga)—(P, C,B,Si,Ge), Fe—(Co, Cr,Mo,Ga,Sb)—P—B—C, (Fe, Co)—B—Si—Nb alloys, and Fe—(Cr—Mo)—(C,B)—Tm, where Ln denotes a lanthanide element and Tm denotes a transition metal element. Furthermore, the amorphous alloy can also be one of the exemplary compositions $Fe_{80}P_{12.5}C_5B_{2.5}$, $Fe_{80}P_{11}C_5B_{2.5}Si_{1.5}$, $Fe_{74.5}Mo_{5.5}P_{12.5}C_5B_{2.5}$, $Fe_{74.5}Mo_{5.5}P_{11}C_5B_{2.5}Si_{1.5}$, $Fe_{70}Mo_5Ni_5P_{12.5}C_5B_{2.5}$, $Fe_{70}Mo_5Ni_5P_{11}C_5B_{2.5}Si_{1.5}$, $Fe_{68}Mo_5Ni_5Cr_2P_{12.5}C_5B_{2.5}$, and $Fe_{68}Mo_5Ni_5Cr_2P_{11}C_5B_{2.5}Si_{1.5}$, described in U.S. Patent Application Publication No. 2010/0300148. Some additional examples of amorphous alloys of different systems are provided in Table 2.

TABLE 2

Exemplary amorphous alloy compositions

| Alloy | Atm % | Atm % | Atm % | Atm % | Atm % | Atm % | Atm % | Atm % |
|---|---|---|---|---|---|---|---|---|
| 1 | Fe | Mo | Ni | Cr | P | C | B | |
| | 68.00% | 5.00% | 5.00% | 2.00% | 12.50% | 5.00% | 2.50% | |
| 2 | Fe | Mo | Ni | Cr | P | C | B | Si |
| | 68.00% | 5.00% | 5.00% | 2.00% | 11.00% | 5.00% | 2.50% | 1.50% |
| 3 | Pd | Cu | Co | P | | | | |
| | 44.48% | 32.35% | 4.05% | 19.11% | | | | |
| 4 | Pd | Ag | Si | P | | | | |
| | 77.50% | 6.00% | 9.00% | 7.50% | | | | |
| 5 | Pd | Ag | Si | P | Ge | | | |
| | 79.00% | 3.50% | 9.50% | 6.00% | 2.00% | | | |
| 6 | Pt | Cu | Ag | P | B | Si | | |
| | 74.70% | 1.50% | 0.30% | 18.0% | 4.00% | 1.50% | | |

In some embodiments, a composition having an amorphous alloy can include a small amount of impurities. The impurity elements can be intentionally added to modify the properties of the composition, such as improving the mechanical properties (e.g., hardness, strength, fracture mechanism, etc.) and/or improving the corrosion resistance. Alternatively, the impurities can be present as inevitable, incidental impurities, such as those obtained as a byproduct of processing and manufacturing. The impurities can be less than or equal to about 10 wt %, such as about 5 wt %, such as about 2 wt %, such as about 1 wt %, such as about 0.5 wt %, such as about 0.1 wt %. In some embodiments, these percentages can be volume percentages instead of weight percentages. In one embodiment, the alloy sample/composition consists essentially of the amorphous alloy (with only a small incidental amount of impurities). In another embodiment, the composition includes the amorphous alloy (with no observable trace of impurities).

In one embodiment, the final parts exceeded the critical casting thickness of the bulk solidifying amorphous alloys.

In embodiments herein, the existence of a supercooled liquid region in which the bulk-solidifying amorphous alloy can exist as a high viscous liquid allows for superplastic forming Large plastic deformations can be obtained. The ability to undergo large plastic deformation in the supercooled liquid region is used for the forming and/or cutting process. As oppose to solids, the liquid bulk solidifying alloy deforms locally which drastically lowers the required energy for cutting and forming. The ease of cutting and forming depends on the temperature of the alloy, the mold, and the cutting tool. As higher is the temperature, the lower is the viscosity, and consequently easier is the cutting and forming.

Embodiments herein can utilize a thermoplastic-forming process with amorphous alloys carried out between Tg and Tx, for example. Herein, Tx and Tg are determined from standard DSC measurements at typical heating rates (e.g. 20° C./min) as the onset of crystallization temperature and the onset of glass transition temperature.

The amorphous alloy components can have the critical casting thickness and the final part can have thickness that is thicker than the critical casting thickness. Moreover, the time and temperature of the heating and shaping operation is selected such that the elastic strain limit of the amorphous alloy could be substantially preserved to be not less than 1.0%, and preferably not being less than 1.5%. In the context of the embodiments herein, temperatures around glass transition means the forming temperatures can be below glass transition, at or around glass transition, and above glass transition temperature, but preferably at temperatures below the crystallization temperature Tx. The cooling step is carried out at rates similar to the heating rates at the heating step, and preferably at rates greater than the heating rates at the heating step. The cooling step is also achieved preferably while the forming and shaping loads are still maintained.

Electronic Devices

The embodiments herein can be valuable in the fabrication of electronic devices using a BMG. An electronic device herein can refer to any electronic device known in the art. For example, it can be a telephone, such as a cell phone, and a land-line phone, or any communication device, such as a smart phone, including, for example an iPhone™, and an electronic email sending/receiving device. It can be a part of a display, such as a digital display, a TV monitor, an electronic-book reader, a portable web-browser (e.g., iPad™), and a computer monitor. It can also be an entertainment device, including a portable DVD player, conventional DVD player, Blue-Ray disk player, video game console, music player, such as a portable music player (e.g., iPod™), etc. It can also be a part of a device that provides control, such as controlling the streaming of images, videos, sounds (e.g., Apple TV™), or it can be a remote control for an electronic device. It can be a part of a computer or its accessories, such as the hard drive tower housing or casing, laptop housing, laptop keyboard, laptop track pad, desktop keyboard, mouse, and speaker. The article can also be applied to a device such as a watch or a clock.

Embodiments

Bulk-solidifying amorphous alloy materials are capable of being shaped and formed, using a variety of forming techniques such as extrusion molding, die casting, injection molding, and the like, to form intricately shaped metal objects that can be used in virtually limitless applications. When formed and cooled in accordance with the guidelines provided herein, the bulk-solidifying amorphous alloy metal objects can form extremely hard, intricately shaped parts that can be used for a variety articles, such as electronic devices, machine parts, engines, pump impellers, rotors, rotating drums, knives, cutting devices, and the like. These parts typically are assembled and connected to other parts that may or may not be made from bulk-solidifying amorphous alloys. In some instances it is desirable that a part has an undercut and/or a threaded portion (e.g., for receiving a screw or fastener). As previously mentioned, when working with amorphous alloys, it is difficult to make intricate details such as undercuts and threaded portions in parts using conventional movable mold tools, because the molten material can fill gaps or holes not intended for part of the final molded part. Also, cutting or machining bulk amorphous material can cause damage to the material and final part. Thus, in accordance with an embodiment herein, there is provided a method for molding, a method for using a mold, and a part formed with at least one undercut. Further details regarding methods for molding, etching, and forming parts with undercuts are described below. Throughout this disclosure, an "undercut" is defined as a beveled edge caused by an etchant attacking an etchable block laterally and optionally vertically. For example, an undercut can project from an inner wall of a part.

In an embodiment, the finished part may also have at least one connection portion such as a threaded portion in its body. For example, the threaded portion can extend through the body of the part and form an opening with threads for receiving a screw or fastener.

Figure 3:
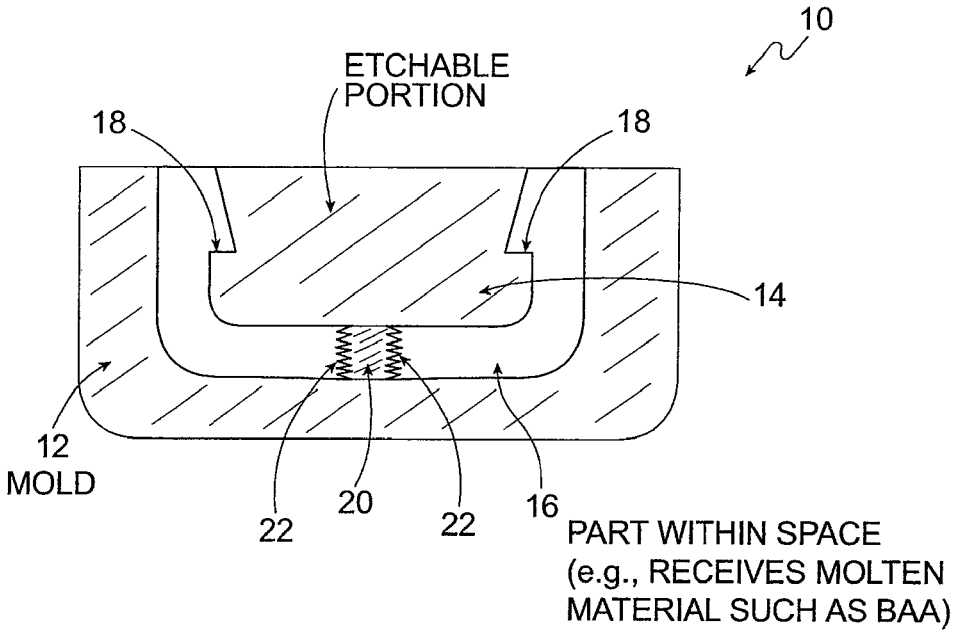
FIG. 3 shows a cross-sectional view of a first mold part with a second mold part of etchable material and has a negative pattern to form an undercut on a molded part in accordance with an embodiment.

FIG. 3 shows a cross-sectional view of a mold 10 having first mold part 12 and a second mold part 14 configured to receive material therein, e.g., in molten form, for molding the material therebetween. In an embodiment, the mold 10 is configured to receive a bulk amorphous alloy. The first and/or second mold parts 12 and 14 are configured to include a negative pattern for forming an undercut on a part molded from the received material, in accordance with an embodiment. For example, the negative pattern is designed to form an undercut 18 on a part 16 that is molded from the material. As shown in the illustrated embodiment of FIG. 3, for example, the second mold part 14 may include an edge that is beveled in an opposite direction to form the desired resultant undercut for the molded part 16.

In an embodiment, the first mold part 12 has a cavity, while the second mold part 14 is in the form of a shaped block. In an embodiment, the second mold part 14 is configured to be inserted and positioned relative to first mold part 12. That is, in an embodiment, the second mold part 14 is configured to be used as an insert. Thus, when the first mold part 12 and second mold part 14 are positioned for molding, a space is formed and provided between the two mold parts 12 and 14., e.g., between the cavity of the first mold part 12 and at least an underside of the second mold part 14. The second mold part 14 is designed to form at least one undercut on a part formed in the space once the molten material cools and hardens.

Second mold part 14 is formed from at least one etchable material. This allows the etchable block to be etched using an etchant, while still forming at least one undercut on the molded part. For example, as can be seen by viewing the example in FIG. 3, at etchant is configured to etch the etchable block of second mold part 14 at least in a lateral direction. In some cases, the etchant can optionally be used to etch away the second mold part 14 a vertical direction.

After the molten material is cooled and hardened, the first mold part 12 is removed (e.g., moved away) and the second mold part 14 is configured to be etched from the molded part 16 using an etchant. Second mold part 14 is removed by etching away at the etchable block, thereby forming a space where second mold part 14 was originally placed. The resulting molded part 16 has an outer wall and an inner wall. Molded part 16 can be a part of an electronic device, as noted above, or other device. Molded part 16 contains at least one beveled edge or undercut 18 projecting from the inner wall, caused by an etchant attacking an etchable block/second mold part 14 laterally and optionally vertically. In an embodiment, substantially no material that forms molded part 16 is removed from underneath the undercut 18.

The first and second mold parts 12 and 14 may be in any size or shape, depending on the final desired product (molded part 16). The shape of the mold parts 12 and 14 is not critical to the embodiments described herein; however, at least one of the mold parts (e.g., second mold part 14) comprises an edge that is beveled that is configured to form an undercut as defined herein.

In one embodiment, the first mold part 12 and/or the second mold part 14 may optionally include a feature designed to form a connection feature such as a threaded bore, or other connection mechanism known in the art, in molded part 16. The first mold part 12 and/or the second mold part 14 can include at least one threaded portion 20 designed to form threads 22 in the body of molded part 16. In one embodiment, the etchable block of second mold part 14 has at least one etchable threaded portion designed to form threads in the cooled molten alloy received in the space between the two mold parts 12 and 14. For example, the at least one etchable threaded portion can extend or protrude into the space for molding. In such a case, in addition to the etchable block, the at least one etchable threaded portion can also be etched for removal from the molded part 16. Thus, one exemplary method for removing the at least one threaded portion extending from the second mold part 14 may include etching the at least one threaded portion.

In another embodiment, the first mold part 12 has a threaded portion designed to form threads in a cooled molten alloy received in the space between the two mold parts 12 and 14. The at least one threaded portion of first mold part 12 can extend or protrude into the space for molding. In such a case, then, the at least at one threaded portion could be machined or removed with or separately from the first mold part 12. Thus, in an embodiment, the method for removing the threaded portion can include machined (e.g., drilling) through the at least one threaded portion to remove it from the molded part 16 (and expose the threads 22 formed therein).

In an embodiment, the at least one threaded portion extends through a body of molded part 16 from the outer wall and the inner wall.

In accordance with an embodiment, there is provided a method for molding, including: providing a molten alloy in a space between a mold cavity (e.g., of first mold part 12 and an etchable block (e.g., second mold part 14) shaped to form an undercut on a part formed in the space. Thereafter, the method can include cooling the molten alloy to form the part 16 with the undercut 18, and etching the etchable block. In an embodiment, the part 16 is made of a bulk amorphous alloy.

Another method for using a mold is also provided herein, using a mold such as mold 10, with first and second mold parts 12 and 14, that is configured to receive bulk amorphous alloy material for molding therebetween. The method can include providing the first mold part 12 and the second mold part 14; providing bulk amorphous alloy into the first and second mold parts, e.g., in a space therebetween; hardening the bulk amorphous alloy; removing the first mold part 12 of mold 10, and removing the second mold part 14 of the mold 10. Because the second mold part 14 includes an etchable material, the removing of the second mold part 14 includes etching the etchable material of the second mold part from the hardened bulk amorphous alloy (from the molded part 16).

Accordingly, the embodiments described herein allow for improvements in forming and/or molding parts with undercuts. At least the etchable block/second mold part 14 includes a pattern that forms at least one undercut and is easily removed, without molten alloy material being able to enter unwanted areas and/or the molded part 16 including unwanted parts (e.g., that may typically need to be machined off later when using conventional molding methods).

Also, parts that are molded from amorphous alloys can not be threaded using traditional methods (e.g., drilling through a part), as they may fatigue, fracture, and/or fail, e.g., due to applied stress or strain, and a general lack of deformation. Thus adding a threaded portion on a first mold part 12 and/or second mold part 14 to form threaded on a molded part 16 is also beneficial in that either the mold part can either be drilled and/or etched away without damaging the bulk amorphous alloy part.

In an embodiment, the etchable block of second mold part 14 is made from at least aluminum material. However, any material that can be subsequently etched and thus removed from molded part 16 using an etchant can be used as the etchable material for second mold part 14. In some instances, it may be preferred that the etchable material not be comprised of a meltable solder or metal alloy or a meltable metal layer.

Suitable etchable materials that can be used to form the etchable second mold part 14 include those that are "wet" etchable and those that are "dry" etchable, and should not be limited (i.e., other materials than the above-mentioned aluminum can be used). Dry-etchable materials are those that can be etched with a particular gas, such as a chlorine based gas, or a fluorine based gas. Suitable materials for dry etching include, for example, chromium, chromium nitride, chromium oxide, chromium oxynitride, and chromium oxycarbonitride, tantalum nitride, tantalum oxide, and mixtures thereof. Other suitable etchable materials that may be wet-etched include, for example, metal oxides and nitrides of Zr, Hf, La, Si, Y, Indium, and Al, photoresist resins, brass, gold, copper, beryllium-copper, molybdenum, nickel, nickel silver, phosphorous-Bronze, platinum, silicon, Carbon Steel, stainless steel, spring steel, titanium, titanium nitride, tungsten, zinc, Monel, and alloys and mixtures thereof. Any suitable etching material may be used, depending on whether the etchable material of second mold part 14 is a dry-etchable material or a wet-etchable material. Suitable wet-etching materials include acids such as hydrofluoric acid, sulfuric acid, or other etchants such as sodium hydroxide, ethylene diamine pyrocatechol (EDP), potassium hydroxid/isopropyle alcohol (KOH/IPA), tetramethylammonium hydroxide (TMAH), and the like. Dry-etchants and dry-etching processes, or those used in plasma etching, may include gases containing chlorine or fluorine, such as, for example, carbon tetrachloride, oxygen (for etching ash photoresist), ion milling or sputter etching using noble gases such as argon, reactive-ion etching, and deep reactive-ion etching. The following table provides suitable etchants (wet and dry) that can be used to etch various etchable materials.

Etchants for Specified material

| Material to be etched | Wet etchants | Plasma etchants |
|---|---|---|
| Aluminum (Al) | 80% phosphoric acid ($H_3PO_4$) + 5% acetic acid + 5% nitric acid ($HNO_3$) + 10% water ($H_2O$) at 35-45° C.; or sodium hydroxide | $Cl_2$, $CCl_4$, $SiCl_4$, $BCl_3$ |
| Indium tin oxide [ITO] ($In_2O_3$:$SnO_2$) | Hydrochloric acid (HCl) + nitric acid ($HNO_3$) + water ($H_2O$) (1:0.1:1) at 40° C. | |
| Chromium (Cr) | Chrome etch: ceric ammonium nitrate ($(NH_4)_2Ce(NO_3)_6$) + nitric acid ($HNO_3$) Hydrochloric acid (HCl) | |
| Copper | Cupric oxide, ferric chloride, ammonium persulfate, ammonia, 25-50% nitric acid, hydrochloric acid, and hydrogen peroxide | |
| Gold (Au) | Aqua regia | |
| Molybdenum (Mo) | | $CF_4$ |
| Organic residues and photoresist | Piranha etch: sulfuric acid ($H_2SO_4$) + hydrogen peroxide ($H_2O_2$) | $O_2$ (ashing) |
| Platinum (Pt) | Aqua regia | |
| Silicon (Si) | Nitric acid ($HNO_3$) + hydrofluoric acid (HF) | $CF_4$, $SF_6$, $NF_3$ $Cl_2$, $CCl_2F_2$ |
| Silicon dioxide ($SiO_2$) | Hydrofluoric acid (HF) Buffered oxide etch [BOE]: ammonium fluoride ($NH_4F$) and hydrofluoric acid (HF) | $CF_4$, $SF_6$, $NF_3$ |
| Silicon nitride ($Si_3N_4$) | 85% Phosphoric acid ($H_3PO_4$) at 180° C. (Requires $SiO_2$ etch mask) | $CF_4$, $SF_6$, $NF_3$ |
| Tantalum (Ta) | | $CF_4$ |
| Titanium (Ti) | Hydrofluoric acid (HF) | $BCl_3$ |
| Titanium nitride (TiN) | Nitric acid ($HNO_3$) + hydrofluoric acid (HF) SCl Buffered HF (bHF) | |
| Tungsten (W) | Nitric acid ($HNO_3$) + hydrofluoric acid (HF) Hydrogen Peroxide ($H_2O_2$) | $CF_4$ $SF_6$ |

Etchable materials and the etchants that can be used for second mold part 14 to selectively remove them are described, for example, in Wolf, S.; R. N. Tauber (1986), *Silicon Processing for the VLSI Era: Volume* 1—*Process Technology*. Lattice Press. pp. 531-534, 546; Walker, Perrin; William H. Tarn (1991), *CRC Handbook of Metal Etchants*. pp. 287-291; and Kohler, Michael (1999). *Etching in Microsystem Technology*. John Wiley & Son Ltd. p. 329. Those having ordinary skill in the art will be capable of utilizing a suitable etchable material for second mold part 14 depending on the desired thickness, the geometry, and the make-up of the at least second mold part 14, using the guidelines provided herein and including at least one edge to form an undercut on a molded part.

An advantage of using an etchable material or block is that the etchable material can be removed using gas or liquid without significantly damaging the part 16 (e.g., including if made from bulk-solidifying amorphous material) or its undercut 18. Using another mold and/or removing the same can damage intricacies of the part like the undercut 18. Moreover, bulk amorphous parts can be damaged if machined, and using an etchable material or block substantially reduces and/or prevents damage.

The embodiments preferably include at least one mold part including an edge that is configured to form an undercut on a molded part, preferably on an inner wall thereof, wherein that mold part can be removed via an etching process without causing damage to the molded part. The result is a molded part with at least one undercut projecting from its inner wall. One or more connection portions, such as a threaded opening or part, can also be formed during the molding process.

The shape of the mold parts 12 and 14 and molded part 16 as shown in FIG. 3 is exemplary only and not mention to be limiting. Rather, the illustrated embodiment is designed to show an example of a mold that has at least one portion that can be used to form an undercut on an inner wall of a part and that material is removed from the undercut via an etching process. The outer wall can include any number of shapes, designs, and/or additional details or configurations (including one or more beveled edges).

While the principles of the disclosure have been made clear in the illustrative embodiments set forth above, it will be apparent to those skilled in the art that various modifications may be made to the structure, arrangement, proportion, elements, materials, and components used in the practice of the disclosure.

It will be appreciated that many of the above-disclosed and other features and functions, or alternatives thereof, may be desirably combined into many other different systems/devices or applications. Various presently unforeseen or unanticipated alternatives, modifications, variations, or improvements therein may be subsequently made by those skilled in the art which are also intended to be encompassed by the following claims.

What is claimed is:

1. A method, comprising:

introducing a molten amorphous alloy into a space between a mold and an etchable insert shaped to form an undercut on a part formed in the space and defining a protruding portion configured to form an opening in the part;

cooling the molten alloy to form the part with the undercut and the opening; and removing the etchable insert from the part by:

etching the etchable insert and drilling into at least part of the protruding portion.

2. The method according to claim 1, wherein:

the protruding portion comprises at least one threaded portion designed to form threads in the part; and the operation of etching the etchable insert includes etching the at least one threaded portion to remove the threaded portion from the part.

3. The method according to claim 1, wherein the mold further comprises at least one threaded portion designed to form threads in the part.

4. The method according to claim 1, wherein the etchable insert is made of aluminum.

5. The method according to claim 1, wherein the part comprises a bulk amorphous alloy.

6. The method of claim 1, wherein the etching is a dry etching process or a wet etching process.

7. The method according to claim 1, wherein the etchable insert is formed from a metal.

8. A method comprising:

introducing an amorphous alloy into a space between a first mold portion and a second mold portion, the second mold portion formed from a metal and comprising a protrusion extending into the space;

hardening the amorphous alloy;

removing the first mold portion; and removing the second mold portion from the hardened amorphous alloy by: machining away at least a portion of the protrusion; and etching the second mold portion.

9. The method according to claim 8, wherein:

the protrusion comprises at least one threaded portion designed to form threads in the hardened amorphous alloy; and the method further comprises etching the at least one etchable threaded portion.

10. The method according to claim 8, wherein the first mold portion comprises at least one threaded portion designed to form threads in the hardened amorphous alloy.

11. The method according to claim 8, wherein the second mold portion is made of aluminum.

12. The method of claim 8, wherein the etching is a dry etching process or a wet etching process.

13. The method of claim 8, wherein:

the second mold portion is shaped to form an undercut on the part; and the operation of hardening the amorphous alloy comprises hardening the amorphous alloy to form the part having the undercut.

14. The method of claim 13, wherein the part comprises a bulk amorphous alloy.

15. A method, comprising:

introducing a molten metal into a space between a first mold portion and a second mold portion such that the molten metal contacts a threaded element;

cooling the molten metal to form the part; drilling into the threaded element to remove a first portion of the threaded element; and etching the threaded element to remove a second portion of the threaded element.

16. The method of claim 15, wherein the threaded element is formed from a metal.

17. The method of claim 15, wherein etching the second portion of the threaded element comprises applying a chemical etchant to the threaded feature.

18. The method of claim 15, wherein etching the threaded element comprises directing a plasma discharge on the threaded element.

19. The method of claim 15, wherein:

the threaded element is a threaded protrusion extending from the first mold portion; and introducing the molten metal into the space between the first mold portion and the second mold portion includes flowing the molten metal around the threaded protrusion.

20. The method of claim 15, wherein the metal is an amorphous alloy.

* * * * *